US005633667A

United States Patent [19]

Miyazawa

[11] Patent Number: 5,633,667

[45] Date of Patent: May 27, 1997

[54] INK CARTRIDGE FOR PRINTER

[75] Inventor: Hisashi Miyazawa, Nagano, Japan

[73] Assignee: Seiko Epson Corporation, Tokyo, Japan

[21] Appl. No.: 334,719

[22] Filed: Nov. 4, 1994

[30] Foreign Application Priority Data

Nov. 5, 1993 [JP] Japan ..... 5-301151

[51] Int. Cl.[6] ..... B41J 2/175

[52] U.S. Cl. ..... 347/86

[58] Field of Search ..... 347/85, 86

[56] References Cited

U.S. PATENT DOCUMENTS

| | | | |
|---|---|---|---|
| 4,162,501 | 7/1979 | Mitchell et al. | 347/86 |
| 4,447,820 | 5/1984 | Terasawa | 347/86 |
| 4,591,875 | 5/1986 | McCann | 347/86 |
| 5,477,963 | 12/1995 | Mochizuki et al. | 347/86 |

FOREIGN PATENT DOCUMENTS

| | | | |
|---|---|---|---|
| 0633138A2 | 1/1995 | European Pat. Off. . | |
| 2709730A1 | 9/1978 | Germany . | |
| 2916472 | 11/1980 | Germany . | |
| A63-162249 | 7/1988 | Japan . | |
| A63-276554 | 11/1988 | Japan . | |
| 276554 | 11/1988 | Japan | 347/86 |
| 2003793 | 3/1979 | United Kingdom . | |

*Primary Examiner*—N. Le

*Attorney, Agent, or Firm*—Stroock & Stroock & Lavan

[57] ABSTRACT

A self-aligning ring for receipt within the ink supply port of an ink cartridge is provided. The ring includes, on the side thereof facing the interior of the ink cartridge, a first annular seal member whose inner diameter is slightly smaller than the outer diameter of an ink supply needle of a recording head, and on the side thereof facing the exterior of the ink cartridge, the ring includes a second annular seal member whose outer diameter is slightly larger than the inner diameter of the ink supply port. The seal members are connected by a thin flexible connecting member. If the ink supply needle is not positioned precisely coaxial with respect to the ink supply port, or even if the ink supply needle is not positioned precisely perpendicular to a recording head, the first annular seal member is displaced to conform with the ink supply needle position by deforming only the thin connecting member, and is hermetically fitted to the ink supply needle. Thus, ink is prevented from leaking from this seal. Where a multichannel ink cartridge for color printing is provided, a self-aligning ring would be mounted in the ink supply port of each compartment for cooperation with an associated ink supply needle.

18 Claims, 5 Drawing Sheets

INK CARTRIDGE FOR PRINTER

BACKGROUND OF THE INVENTION

The present invention relates generally to an ink cartridge for use with an ink-jet type recording apparatus and, more particularly, to an ink cartridge for use with an ink-jet type recording apparatus which compensates for misalignment of the ink supply port and ink supply needle to stop any ink from leaking.

Ink-jet the recording apparatuses use liquid ink to print recording data. Particularly, an ink-jet type recording apparatus employs an ink cartridge that supplies ink contained therein to the recording head. The ink cartridge is directly connected to the recording head through the use of an ink supply needle mounted on the recording head. Ink is delivered by utilizing a pressure difference between the ink in the recording head and the ink in the ink cartridge, and by capillary forces.

As a result of this construction, the ink cartridge is required to have a structure for connecting the ink cartridge to the ink supply needle. This structure is disposed either on the lower surface of the ink cartridge or below the ink cartridge itself. This arrangement of the connecting structure in turn requires that an appropriate measure be taken to contain leakage of ink from the ink cartridge when the cartridge is connected to the ink supply needle. As has already been disclosed in Japanese Unexamined Patent Publication No. 50-74341, one method of dealing with the leaking of ink which is widely used is to employ a package having a through-hole and a seal that allows the ink supply needle to be hermetically fitted into this through-hole at the ink supply port of the ink cartridge. With this structure, the ink cartridge can be positioned and retained in contact with the recording head without allowing any ink to leak by inserting the ink supply needle into the through-hole of the package so as to pierce the seal.

In order to prevent any ink from leading, the ink supply port provided on the ink cartridge must have a minimal diameter. This design further requires a minimal diameter for the through-hole in the packing that is disposed in the ink supply port. However, if the ink supply needle is not positioned precisely coaxial with the through-hole in the packing disposed in the ink supply port, or if the ink supply needle is not perfectly perpendicular with respect to the packing disposed in the ink supply port, then the ink supply needle will not be centered upon insertion into the through-hole of the packing. As a result, the ink supply needle will be in contact with only a portion of the packing, whereas the remaining portion of the packing will not come in contact with the ink supply needle. Thus, ink will leak from between the ink supply needle and the packing where the ink supply needle does not contact the packing.

This problem of leaking ink also arises from inconsistent positioning tolerances among the multiple ink supply needles in a recording head for a color printer using more than one ink supply needle to supply color inks to a recording head from a plurality of color ink tanks. In many cases, the plurality of color ink tanks is provided as a plurality of compartments in a single tank, so that the spacing between the connecting structures of the ink tank compartment and between the respective ink supply needles is fixed, aggravating the tolerance problem.

Accordingly, the present invention provides an ink tank with a seal which compensates for inconsistent positioning of ink-supply needles, or inconsistent inclines of ink-supply needles and keeps ink from leaking from the ink supply tank while in use.

SUMMARY OF THE INVENTION

Generally speaking, in accordance with the present invention, a novel ink cartridge is provided which is capable of compensating for any displacement of the ink supply needle with respect to the ink supply port at the time the ink supply needle is connected to the ink supply port. The needle and port can be connected without allowing the ink to leak.

The ink cartridge of the present invention comprises a self-aligning ring operatively coupled to the ink supply port of the ink cartridge on the outlet or recording head side. In operation, the ink supply port is coupled with an ink supply needle emanating from the recording head through the self aligning ring. The self-aligning ring includes: a first annular seal member whose inner diameter is slightly smaller than an outer diameter of the ink supply needle; a second annular seal member whose outer diameter is slightly larger than an inner diameter of the ink supply port; and a thin connecting member for connecting the two seal members. When coupled, even if the ink supply needle is not located precisely coaxial with the ink supply port, the ink supply needle can be connected to the ink supply port hermetically by flexing the thin connecting member, thereby eliminating any leaking of the ink.

Accordingly, it is an object of this invention to provide an improved ink transfer mechanism for transferring between an ink cartridge and a recording head.

Another object of the invention is to provide an improved ink transfer mechanism capable of compensating for any misalignment of the ink supply needle with respect to the ink supply port during use.

A further object of the invention is to provide an improved ink transfer mechanism wherein a self-aligning ring permits a hermetic seal between an ink cartridge and a recording head regardless of misalignment of the ink supply needle with respect to the ink supply port during use.

Still other objects and advantages of the invention will in part be obvious and will in part be apparent from the specification and drawings.

The invention accordingly comprises the features of construction, combination of elements, and arrangement of parts, which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
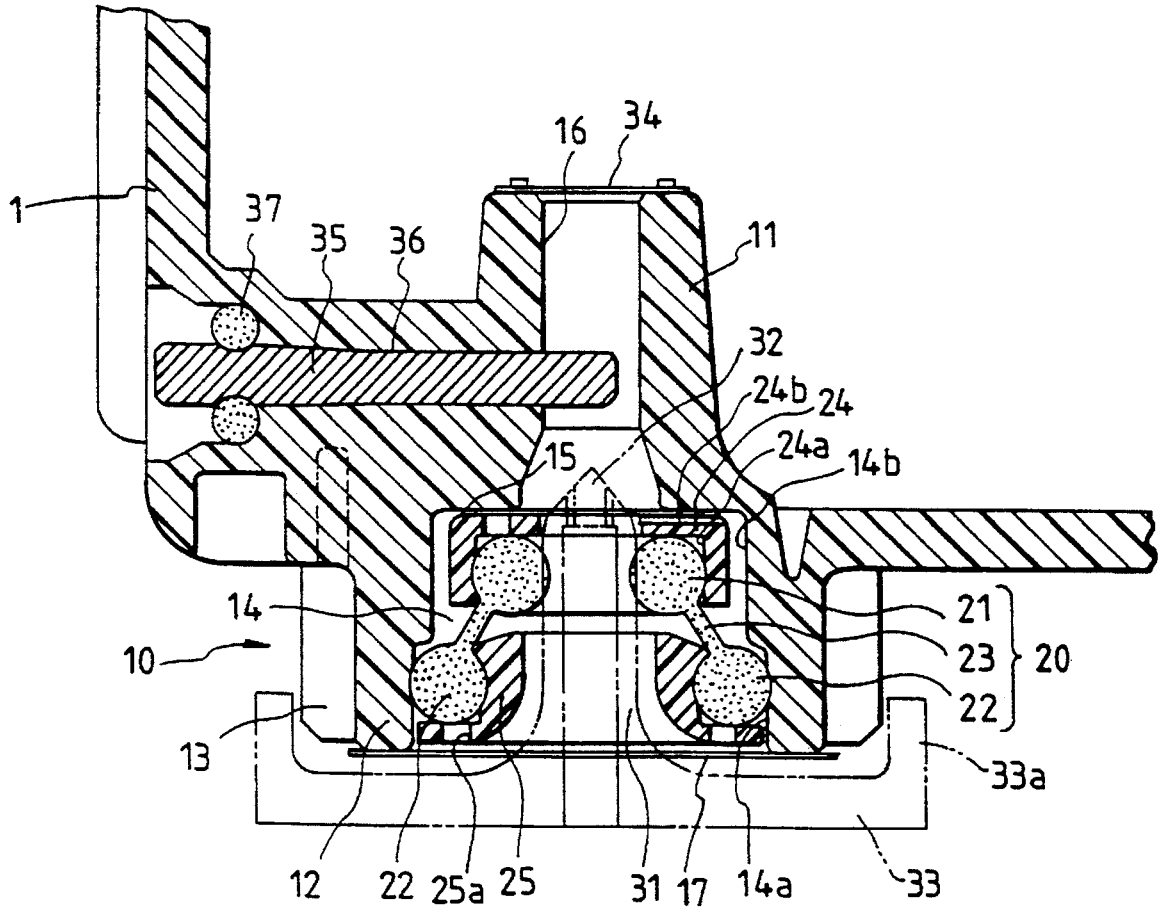
FIG. 1 is a fragmentary enlarged cross-sectional view of an ink cartridge and recording head combination constructed in accordance with a preferred embodiment of the present invention.
Figure 2:
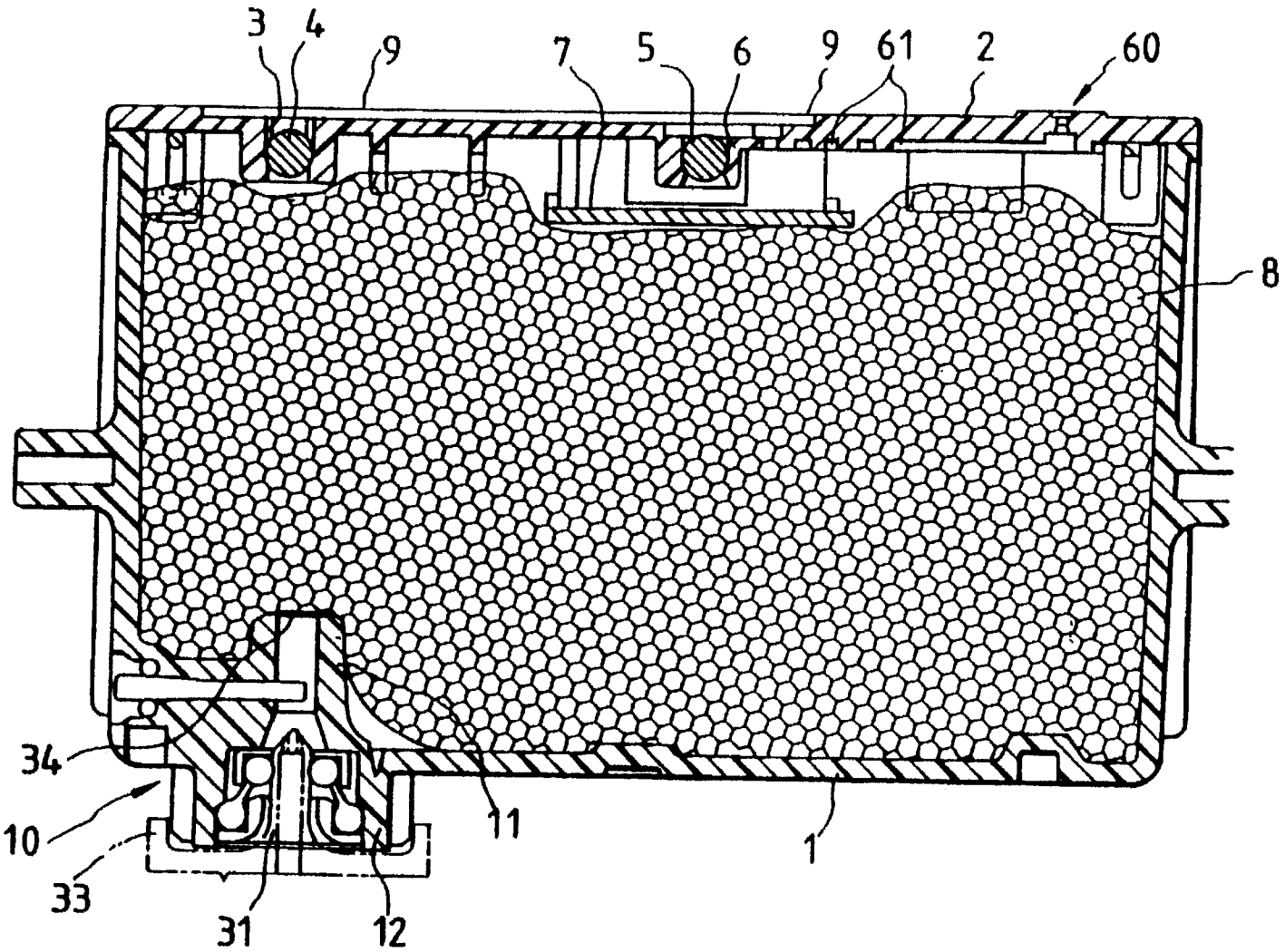
FIG. 2 is a cross-sectional view of the ink cartridge of FIG. 1 constructed in accordance with a preferred embodiment of the present invention shown mounted on an ink supply needle.

FIGS. 1 and 2 show an ink cartridge constructed in accordance with a preferred embodiment of the present invention. The ink cartridge of this embodiment is designed for monochromatic printers. Referring to FIG. 2, an ink cartridge main body, indicated generally as 1, is integrally formed into a box having an opening on top. Ink cartridge main body 1 is made of a resin material that suppresses evaporation of ink and is constructed to allow air passage.

The upper opening of ink cartridge main body 1 is covered integrally with a cover 2 having both an ink charging port 3 sealed by a spherical stopper 4 and an air vent 5 similarly sealed by a spherical stopper 6 designed to permit air flow into the ink cartridge while preventing ink loss. The air vent 5 communicates with atmosphere through a winding groove 61 and an air communication hole 60. An ink supply port, indicated generally as 10, is formed on one side of the bottom of ink cartridge main body 1. Ink supply port 10 communicates with an ink supply needle 31 of a recording head (not shown). Further, an ink absorbing member 8, formed of a flexible porous material, is disposed within main body 1. A biasing plate 7 is positioned with respect to cover 2 to form a gap between cover 2 and ink absorbing member 8. The ink supply needle is positioned relative to the ink cartridge by a positioning member 33 which is dimensioned to receive an outwardly projecting portion 12 of the ink receiving and transmitting portion of the ink cartridge which defines the ink supply port.

Reference is now made to FIG. 1, wherein ink supply port 10 is shown in enlarged form. Ink supply port 10 includes an inward projecting portion 11 and an outward projecting portion 12. Inward projecting portion 11 projects inward into ink cartridge main body 1 to bias ink absorbing member 8. Outward projecting portion 12 projects outward from ink cartridge main body 1 to position ink cartridge main body 1. Inward projecting portion 11 assists the flow of ink within ink absorbing member 8 to ink supply port 10 by compressing ink absorbing member 8 in the area adjacent inward projecting portion 11 to produce an average pore diameter of ink absorbing member 8 at this location smaller than the average pore diameter of absorbing body 8 at locations not adjacent inward projecting portion 11. This reduction in the average pore diameter in the vicinity of inward projecting portion 11 increases the capillary force, assisting the ink flow to ink supply port 10. Mesh filter 34 is positioned at the end of inwardly projecting portion 11 to assist in preventing particles and air bubbles from entering the ink supply port. Outward projecting portion 12 positions ink cartridge main body 1 by engaging a plurality of ribs 13 arranged on the circumferential surface of ink cartridge main body 1 with an annular positioning projected edge 33 disposed on the back of the recording head and also aids in connecting ink supply port 10 to ink supply needle 31.

A stepped insertion hole 14 in outward projecting portion 12 is dimensioned to receive a self-aligning ring 20 (described below). In addition, a through-hole 16 serving as an ink through-hole (part of the ink supply port) is provided in inward projecting portion 11. Stepped insertion hole 14 and through-hole 16 are formed coaxially so as to communicate with each other when ink cartridge main body 1 is coupled with in supply needle 31 of the recording head.

Self-aligning ring 20 will now be described with reference to FIG. 1. Self-aligning ring 20 is made of a flexible resin material and comprises three distinct portions. A ring-like annular needle seal 21 (the first seal) having a circular form in section is coupled with a ring-like annular port seal 22 (the second seal) having a circular form in section by a thin truncated conical connecting ring 23 that is thinner than annular needle seal 21 or annular port seal 22 in the axial direction. The inner diameter of annular needle seal 21 is slightly smaller than the outer diameter of ink supply needle 31. The outer diameter of annular port seal 22 is slightly larger than the inner diameter of an entrance portion 14*a* of stepped insertion hole 14.

A ring-like movable bush 24 having an L-shaped form in cross section is fitted adjacent annular needle seal 21 from outside so as to suppress the expansion of needle seal 21. The inner diameter of movable bush 24 is substantially smaller than the inner diameter of a portion 14*b* of stepped insertion hole 14. In addition, a ring-like fixed bush 25 having an L-shaped form in section is positioned within annular port seal 22 so as to insure fixed bush 25 remains in contact with the inner surface of entrance portion 14*a* of stepped insertion hole 14. Fixed bush 25 is dimensioned so that the inner end of fixed bush 25 does not come in contact with needle seal 21. Fixed bush 25 guides ink supply needle 31 into stepped insertion hole 14 during insertion. Fixed bush 25 is mounted in such a manner that movable bush 24 is in sliding contact with stepped portion 15 within stepped insertion hole 14 and that fixed bush 25 is fitted into entrance portion 14*a* of insertion hole 14.

Radially extending projected bars 24*a* are formed on the inner end surface 9 movable bush 24 and are maintained in sliding contact with stepped portion 15 within stepped insertion hole 14. When ink is injected into ink cartridge main body 1, ink cartridge main body 1 is evacuated to a negative pressure. A plurality of through-holes 24*b* are formed between projected bars 24*a* of movable bush 24 so that essentially all of the air within stepped insertion hole 14 can be released from around self-aligning ring 20 through through-holes 24*b* between the projected bars 24*a*. Additional through holes 25*a* are formed in fixed bush 25 for the same purpose. The releasing of the air in this manner prevents the ink charging pressure from causing self-aligning ring 20 from being detached from insertion hole 14. In effect, during injection of the ink into ink cartridge body 1 under negative pressure, ink essentially occupies the portion of insertion hole 14 not occupied by self-aligning ring 20, movable bush 24, and fixed bush 25.

First seal member 9 in FIG. 2 seals the opening end of ink charging port 3, and second seal member 17 in FIG. 1 seals the opening end of ink supply port 10, and is penetrated by ink supply needle 31 during mounting of the ink supply cartridge.

An electrode 35 extends through a bore 36 in a wall of ink cartridge body 1 and serves as one electrode of an ink exhaustion sensor to inform the user that the ink cartridge requires replacement. An O-ring 37 prevents escape of ink through bore 36.

Figure 3:
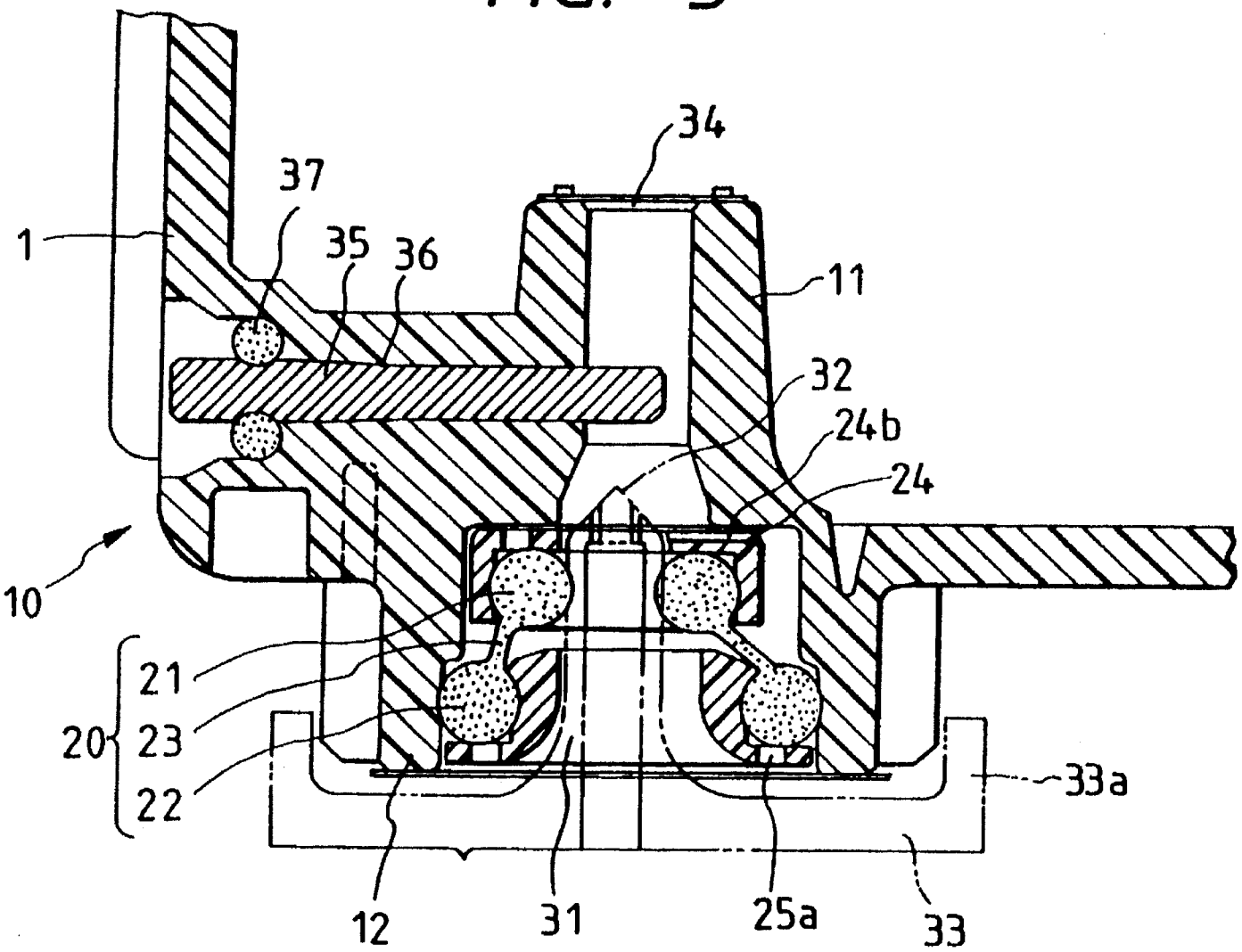
FIG. 3 is a fragmentary enlarged cross-sectional view of the ink cartridge and recording combination of FIG. 1 illustrating the operation of the invention where the ink supply needle is not properly aligned.

The procedure for attaching ink cartridge main body 1 to a recording head will now be described. Ink cartridge main body 1 is coupled with the recording head in such a manner so as to align ink supply port 10 with ink supply needle 31. Ink supply needle 31 is inserted into ink supply port 10 while piercing seal member 17 that seals ink supply port 10. Ink supply needle 31 then enters into through-hole 16 and is hermetically fitted with movable bush 24. Simultaneously therewith, ribs 13 disposed around the circumference of the outward projecting portion 12 are fitted into annular positioning projected edge 33*a* of positioning member 33 disposed on the recording head to thereby fix ink cartridge main body 1 in position. Ink cartridge main body 1 is attached to the recording head so as to align ink supply needle 31 with positioning projected edge 33 even if ink supply needle 31 is not projected precisely coaxial with through-hole 16, or if ink supply needle 31 does not project precisely perpendicularly from the recording head. As shown in FIG. 3, ink supply needle 31 is hermetically fitted to needle seal 21 even if not properly situated without greatly deforming needle seal 21. Needle seal 21 moves with movable bush 24 along stepped portion 15 within insertion hole 14 upon insertion of tapered tip portion 32 of ink supply needle 31, and thin conical connecting ring 23 is deformed and displaced in the radial direction outward. Thus, ink supply needle 31 is correctly fitted regardless of the precise position or angle of ink supply needle 31. Reference is now made to FIG. 3 which depicts the positioning of the movable bush 24 and self-aligning ring 20 when an ink supply needle 31 is not aligned with the axis of insertion hole 14.

Figure 4:
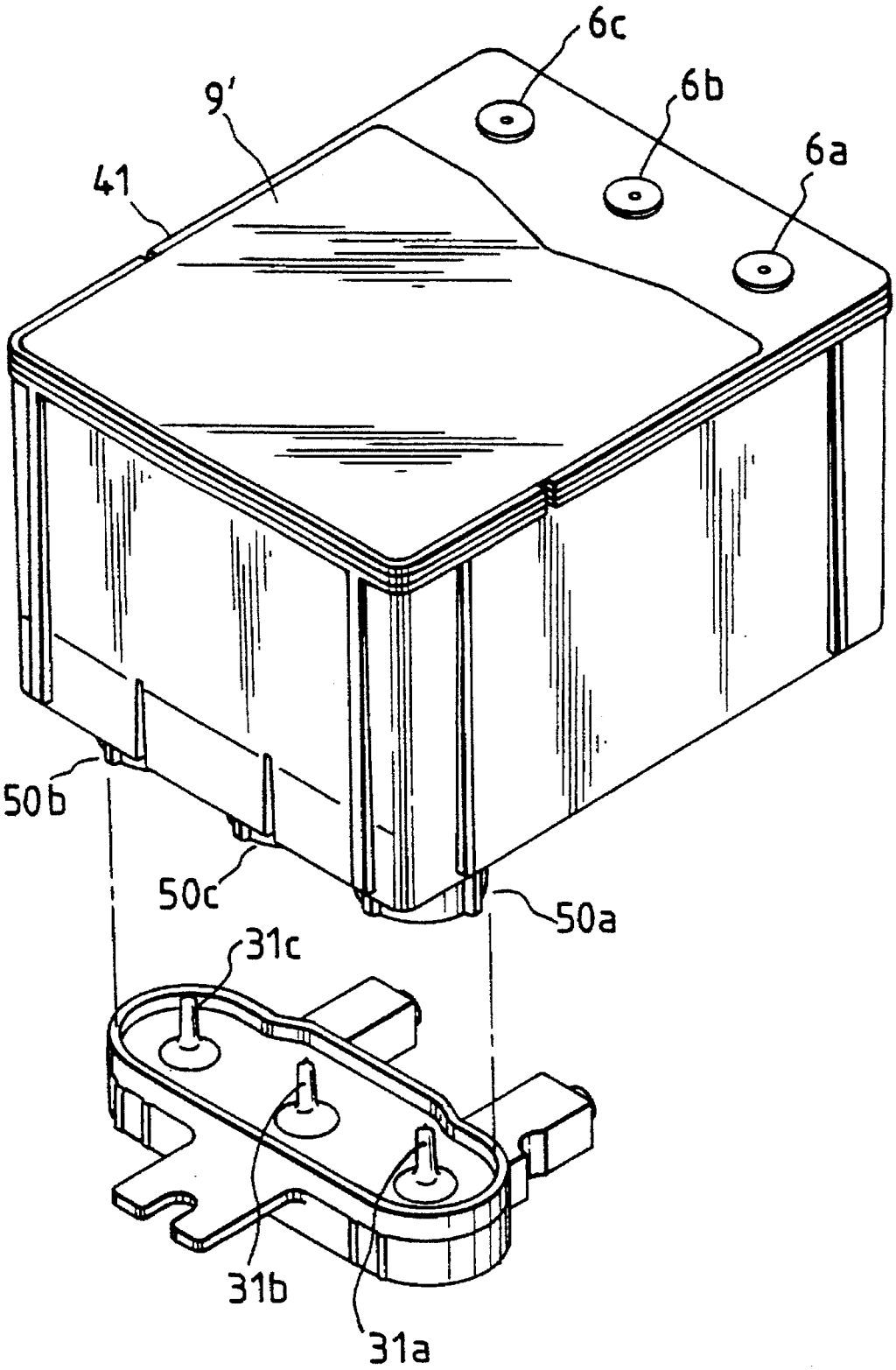
FIG. 4 is an exploded perspective view of a multi compartment ink cartridge for color printing and associated recording head combination constructed in accordance with a second embodiment of the present invention.
Figure 5:
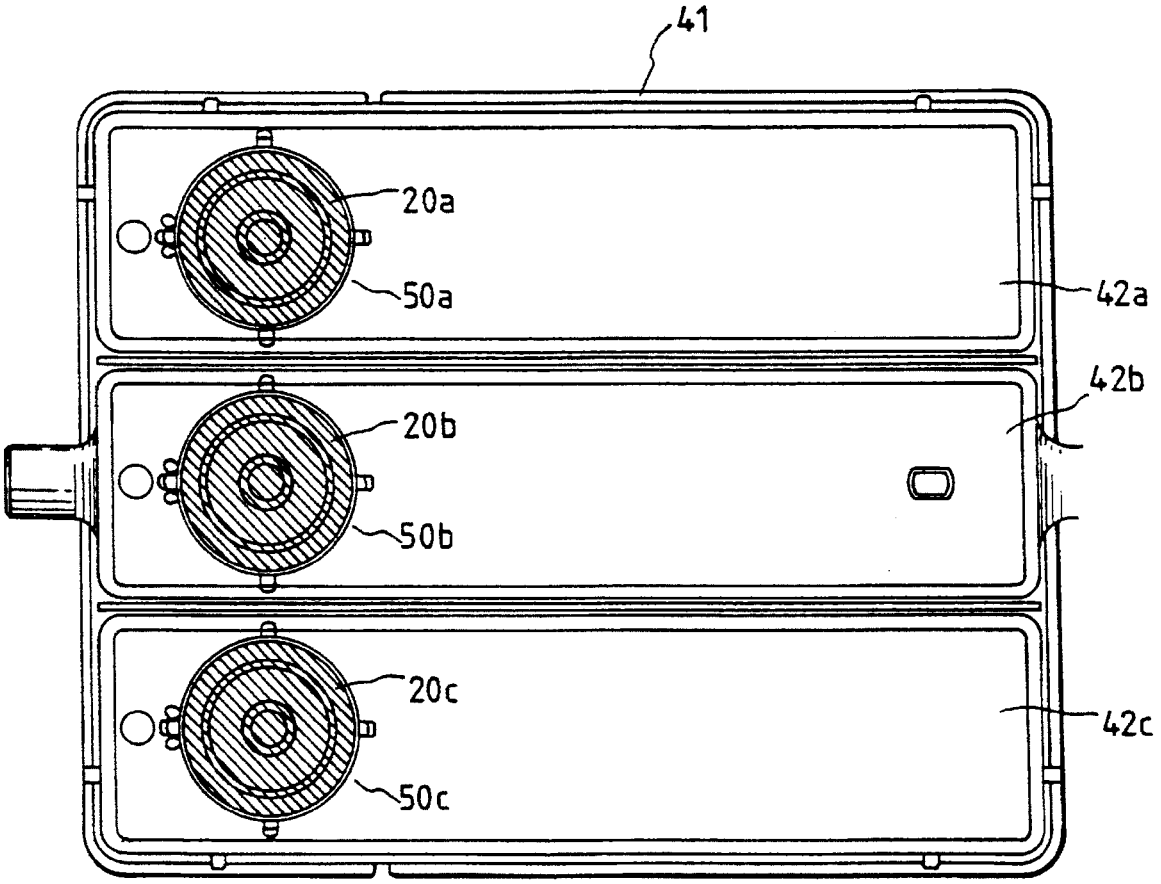
FIG. 5 is a bottom plan view of the ink cartridge of FIG. 4 constructed in accordance with the second embodiment of the present invention.

Reference is now made to FIGS. 4 and 5 wherein a second embodiment of the present invention is shown, like elements being given like reference numerals. This second embodiment depicts a mechanism for use with color or other multi-ink printers. A cartridge main body 41 has a plurality of ink tanks or compartments 42*a*, 42*b*, 42*c* fixed integrally thereto for containing different color inks. Ink supply ports 50*a*, 50*b*, 50*c* having similar self-aligning rings 20*a*, 20*b*, 20*c* are disposed on the bottoms of ink tanks 42*a*, 42*b*, 42*c*. Each ink tank 42*a*, 42*b* and 42*c* has an air vent sealed by a stopper 6*a*, 6*b* and 6*c* respectively (FIG. 4). The ink charging ports of the three ink tanks or compartments are covered and sealed by sheet member 9'.

In the situation where ink cartridge 41 is attached to a recording head having inconsistent positioning tolerances among ink supply needles 31*a*, 31*b*, 31*c* (FIG. 5), self-aligning rings 20*a*, 20*b*, 20*c* inside the ink supply ports 50*a*, 50*b*, 50*c* are designed so that the misaligned ink supply needles displace the respective needle seals 21 and movable bushes 24 as described above so as to align each needle seal 21 with the position of the corresponding ink supply needle 31*a*, 31*b*, 31*c* while flexing each corresponding thin conical connecting ring 23. This construction thereby prevents the ink from leaking, and permits fitting and retaining each ink supply needle 31*a*, 31*b*, 31*c* hermetically with the corresponding needle seal 21 by only deforming the thin connecting members 23.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An ink cartridge for mounting on an ink supply needle of a recording head, comprising:

an ink cartridge main body having a plurality of walls;

an ink supply port disposed in a wall of said ink cartridge main body and communicating from an interior to an exterior of said ink cartridge for the flow of ink therethrough, said ink supply port defining a stepped insertion hole, said stepped insertion hole comprising a first portion having a first diameter and a second portion having a second diameter greater than said first diameter; and a self-aligning ring mounted within said ink supply port and having an interior facing side and an exterior facing side, said self-aligning ring further comprising:

a first annular seal member on the interior facing side of said self-aligning ring and having an inner diameter less than an outer diameter of said ink supply needle;

a second annular seal member on the exterior facing side of said self-aligning ring and having an outer diameter greater than an inner diameter of said second portion of said stepped insertion hole of said ink supply port; and a flexible connecting member coupling said first annular seal member and said second annular seal member to permit essentially lateral displacement of said first annular seal member relative to said second annular seal member in said ink supply port.

2. The ink cartridge of claim 1, and including an annular movable bush disposed on an outer circumference of said first annular seal member having an inner diameter smaller than an outer diameter of said first annular seal member and an outer diameter smaller than the diameter of said first portion of said stepped insertion hole of said ink supply port to limit the expansion of said first annular seal member.

3. The ink cartridge of claim 2, wherein said annular movable bush has an essentially L-shape in cross section having a first portion positioned parallel to said stepped insertion hole and a second portion positioned perpendicular to said stepped insertion hole, said first portion of said annular movable bush being engaged by said outer circumference of said first annular seal member, said second portion of said annular movable bush being engaged on the interior side of said first annular seal member.

4. The ink cartridge of claim 3, wherein said ink supply port is formed with a stepped interior construction between said first and said second portions of said stepped insertion hole forming an interior step, for receiving said self aligning ring with an interior side of said second portion of said movable bush facing and engaging said interior step of said ink supply port.

5. The ink cartridge of claim 4, wherein said interior side of said second portion of said movable bush is formed with radially extending spaced projections extending toward and engaging said interior step.

6. The ink cartridge of claim 5, wherein said second portion of said movable bush is formed with at least one through hole in a region between said projections providing communication between the interior and exterior of said movable bush.

7. The ink cartridge of claim 1, and including an annular fixed bush for guiding said ink supply needle disposed along an inner circumference of said second annular seal member to engage said second annular seal member against an inner circumference of said second portion of said ink supply port.

8. The ink cartridge of claim 7, wherein said annular fixed bush has essentially an L-shape in cross-section, having a first portion positioned parallel to said stepped insertion hole and a second portion positioned perpendicular to said stepped insertion hole, said first portion of said annular fixed bush being engaged by said inner circumference of said second annular seal member, said second portion of said annular fixed bush being engaged by an exterior side of said second annular seal member.

9. The ink cartridge of claim 8, wherein said second portion of said annular fixed bush is formed with at least one through hole providing communication between the interior and exterior of said fixed bush.

10. An ink cartridge for mounting on a recording head having at least two ink supply needles, comprising:

at least two ink cartridge main bodies joined as a unit, each ink cartridge main body having an exterior wall;

an ink supply port in said exterior wall of each of said ink cartridge main bodies so as to be in essential registration with one of said ink supply needles, said ink supply port communicating from an interior to an exterior of its respective ink cartridge main bodies for the flow of ink therethrough, each of said ink supply ports defining a stepped insertion hole, said stepped insertion hole comprising a first portion having a first diameter and a second portion having a second diameter greater than said first diameter; and a respective self-aligning ring mounted within each said ink supply port and having an interior facing side and an exterior facing side, said self-aligning rings further comprising:

a first annular seal member on the interior facing side of said self-aligning ring and having an inner diameter less than an outer diameter of the associated ink supply needle;

a second annular seal member on the exterior facing side of said self-aligning ring and having an outer diameter greater than an inner diameter of said second portion of said stepped insertion hole of the associated ink supply port; and a flexible connecting member coupling said first annular seal member and said second annular seal member to permit essentially lateral displacement of said first annular seal member relative to said second annular seal member in the associated ink supply port.

11. The ink cartridge of claim 10, and including an annular movable bush disposed on an outer circumference of said first annular seal member having an inner diameter smaller than an outer diameter of said first annular seal member and an outer diameter smaller than the diameter of said first portion of said stepped insertion hole of the associated ink supply port to limit the expansion of said first annular seal member.

12. The ink cartridge of claim 11, wherein said first annular seal has an interior side and said annular movable bush has an essentially L-shape in cross section having a first portion positioned parallel to said stepped insertion hole and a second portion positioned perpendicular to said stepped insertion hole, said first portion of said annular movable bush being engaged by said outer circumference of said first annular seal member, said second portion of said annular movable bush being engaged on the interior side of said first annular seal member.

13. The ink cartridge of claim 12, wherein said second portion has an interior side and said ink supply ports are each formed with a stepped interior construction between said first and second portions of said stepped insertion hole forming an interior step, for receiving the associated self aligning ring with the interior side of said second portion of said associated movable bush facing and engaging said interior step of the associated ink supply port.

14. The ink cartridge of claim 13, wherein said interior side of said second portion of each movable bush is formed with radially extending spaced projections extending toward and engaging the associated step.

15. The ink cartridge of claim 14, wherein said moveable bush has an interior and an exterior and said second portion of each of said movable bushes is formed with at least one through hole in a region between said projections providing communication between the interior and exterior of said movable bush.

16. The ink cartridge of claim 10, wherein said second portion of each ink supply port has an inner circumference and including an annular fixed bush guiding each said ink supply needle disposed along an inner circumference of each of said second annular seal members to engage said second annular seal member against the inner circumference of said second portion of the associated ink supply port.

17. The ink cartridge of claim 16, wherein each of said annular fixed bushes has essentially an L-shape in cross-section having a first portion positioned parallel to said stepped insertion hole and a second portion positioned perpendicular to said stepped insertion hole, a first portion of said annular fixed bush being engaged by said inner circumference of the associated second annular seal member and a second portion of said annular fixed bush being engaged by an exterior side of the associated second annular seal member.

18. The ink cartridge of claim 17, wherein each said fixed bush has an interior and an exterior and said second portion of each of said fixed bushes is formed with at least one through hole providing communication between the interior and exterior of the associated fixed bush.

* * * * *